US012053143B2

(12) United States Patent
Conrad

(10) Patent No.: US 12,053,143 B2
(45) Date of Patent: Aug. 6, 2024

(54) CHARGING STATION FOR A SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Ontario (CA)

( * ) Notice: Subject to any disclaimer, the term of this patent is extended or adjusted under 35 U.S.C. 154(b) by 662 days.

(21) Appl. No.: 17/224,839

(22) Filed: Apr. 7, 2021

(65) Prior Publication Data

US 2022/0322904 A1 Oct. 13, 2022

(51) Int. Cl.
*A47L 9/28* (2006.01)

(52) U.S. Cl.
CPC ..... *A47L 9/2873* (2013.01); *A47L 9/2884* (2013.01); *A47L 2201/022* (2013.01)

(58) Field of Classification Search
CPC ..... A47L 9/2873; A47L 9/2884; A47L 2201/022; A47L 5/26
See application file for complete search history.

(56) References Cited

U.S. PATENT DOCUMENTS 4,969,229 A * 11/1990 Svanberg ..... A47L 9/2842 15/344
9,545,181 B2 1/2017 Conrad
10,165,912 B2 1/2019 Conrad
10,251,519 B2 * 4/2019 Conrad ..... A47L 5/225
11,033,164 B2 * 6/2021 Conrad ..... A47L 5/225
11,229,333 B2 * 1/2022 Conrad ..... A47L 9/2878
11,246,465 B2 * 2/2022 Conrad ..... A47L 9/2878
2012/0235636 A1 * 9/2012 Partovi ..... H02J 50/80 320/108
2016/0174786 A1 * 6/2016 Conrad ..... A47L 5/225 15/329
2020/0221912 A1 * 7/2020 Caspar ..... A47L 9/2884
2020/0260923 A1 * 8/2020 Conrad ..... A47L 9/1625
2020/0260925 A1 * 8/2020 Conrad ..... A47L 9/16
2020/0260926 A1 * 8/2020 Conrad ..... A47L 9/2884
2022/0031131 A1 * 2/2022 Mcclay ..... A47L 5/225
2022/0061614 A1 * 3/2022 Yu ..... A47L 9/0072
2022/0287528 A1 * 9/2022 Paulla ..... A47L 9/2873
2023/0329503 A1 * 10/2023 Lee ..... A47L 9/2831
2023/0337875 A1 * 10/2023 Stringer ..... A47L 9/2894
2023/0371466 A1 * 11/2023 Hetzenauer ..... A01K 1/0139
2023/0373326 A1 * 11/2023 Svensson ..... B60L 50/52
2023/0379870 A1 * 11/2023 Gorilovsky ..... H04W 64/006

FOREIGN PATENT DOCUMENTS

WO WO-2022069872 A1 * 4/2022 ..... A47L 9/0063

OTHER PUBLICATIONS

Shark WandVac System, VS630 Series: Owners Guide, copyright at least as early as Apr. 6, 2021.

* cited by examiner

*Primary Examiner* — Stacy Whitmore
(74) *Attorney, Agent, or Firm* — Philip C. Mendes da Costa; BERESKIN & PARR LLP/S.E.N.C.R.L., s.r.l.

(57) ABSTRACT

A surface cleaning apparatus having dual energy storage packs and a charging station having a charging unit for each energy storage pack.

14 Claims, 10 Drawing Sheets

CHARGING STATION FOR A SURFACE CLEANING APPARATUS

FIELD

This application relates to the field of surface cleaning apparatus which are operable in a cordless mode and charging stations for the same.

INTRODUCTION

The following is not an admission that anything discussed below is part of the prior art or part of the common general knowledge of a person skilled in the art.

Various types of surface cleaning apparatus are known, including upright surface cleaning apparatus, canister surface cleaning apparatus, stick surface cleaning apparatus, central vacuum systems, and hand carriable surface cleaning apparatus such as hand vacuums. Further, various designs for cyclonic hand vacuum cleaners, including battery operated cyclonic hand vacuum cleaners, are known in the art.

Battery operated hand vacuum cleaners, such as the Shark Wandvac™ hand vac are sold with a docking station. When the hand vacuum cleaner is docked in the docking station, and the docking station is connected to a household electrical outlet, the on board batteries are may be recharged. Similarly, a robotic vacuum cleaner is recharged when the robotic vacuum cleaner docks at a docking station which is connected to a household electrical outlet.

SUMMARY

The battery operated hand vacuum cleaners and the battery operated robotic vacuum cleaners have a single battery pack which powers the vacuum cleaner and which is recharged when the vacuum cleaner is docked or placed in a charging stand. In these designs, all of the batteries are provided in a single battery pack.

A surface cleaning apparatus is provided with two or more battery packs (or, more generally, energy storage packs). Each battery pack may comprise one or more batteries and each energy storage pack may comprise one or more energy storage members. Each energy storage pack may power a different component of the surface cleaning apparatus. For example, in the case of an upright vacuum cleaner, a first energy storage pack may be used to power the suction motor and a second energy storage pack may be used to power a brush motor and/or a motor that is drivingly connected to the wheels of a surface cleaning head. Similarly, a robotic vacuum cleaner may have a first energy storage pack that may be used to power the suction motor and a second energy storage pack may be used to power a brush motor and the drive motor. These energy storage packs may be positioned at different locations. For example, in an upright vacuum cleaner which as a lift away portable cleaning unit for above floor cleaning, the first energy storage pack may be located in the portable cleaning unit (e.g., the portable cleaning unit may be mounted on the upright assembly of the upright vacuum cleaner) and the second energy storage pack may be provided in the surface cleaning head. In such a configuration, each battery may would have to be charged and, optionally, charged concurrently.

In accordance with one aspect of this disclosure, a charging station for a surface cleaning apparatus is provided which can concurrently charge two energy storage packs. Accordingly, the charging station may have a first charging output member and a second charging output member. When the surface cleaning apparatus is docked at the charging station, the first charging output member is electrically connected to a first rechargeable energy storage member of the surface cleaning apparatus and the second charging output member is electrically connected to a second rechargeable energy storage member of the surface cleaning apparatus. An advantage of this design is that each of the first and second energy storage members may be charged simultaneously. Accordingly, a user may more rapidly charge the surface cleaning apparatus so that there is less downtime required between uses.

In accordance with this aspect, there is provided a charging station for a surface cleaning apparatus comprising:

a) a first charging output member wherein, when the surface cleaning apparatus is docked at the charging station, the first charging output member is electrically chargeably connected with a first rechargeable energy storage member provided on the surface cleaning apparatus; and, b) a second charging output member wherein, when the surface cleaning apparatus is docked at the charging station, the second charging output member is electrically chargeably connected with a second rechargeable energy storage member provided on the surface cleaning apparatus.

In any embodiment, the first charging output member may comprise first electrical contacts provided on a main body of the charging station.

In any embodiment, the second charging output member may comprise second electrical contacts provided on a main body of the charging station.

In any embodiment, the second charging output member may comprise a wireless charging member.

In any embodiment, the first rechargeable energy storage member and the second rechargeable energy storage member may be provided at different locations on the surface cleaning apparatus.

In any embodiment, the charging station may further comprise a first charging unit comprising the first charging output member and a second charging unit comprising the second charging output member wherein the first charging unit may have a first energy output rate and the second charging unit may have a second energy output rate that is higher than first energy output rate.

It will be appreciated that the charging station may be sold by itself or in combination with one or more surface cleaning apparatus. Therefore, in accordance with this aspect, there is also provided an apparatus comprising a surface cleaning apparatus and a charging station for the surface cleaning apparatus wherein:

a) the surface cleaning apparatus comprises:
   - i) a surface cleaning head having a dirty air inlet,
   - ii) an air flow path extending from the dirty air inlet to a clean air outlet with an air treatment member and a suction motor provided in the air flow path;
   - iii) a first energy storage member which, in operation, is electrically connected to the suction motor; and,
   - iv) a second energy storage member which, in operation, is electrically connected to another electrically powered member, and b) the charging station comprises:
   - i) a first charging output member wherein, when the surface cleaning apparatus is docked at the charging station, the first charging output member is electrically chargeably connected with the first rechargeable energy storage member; and, ii) a second charging output member wherein, when the surface cleaning apparatus is docked at the charging station, the second charging output member is electrically chargeably connected with the second rechargeable energy storage member.

In any embodiment, the first rechargeable energy storage member and the second rechargeable energy storage member may be provided at different locations on the surface cleaning apparatus.

In any embodiment, the surface cleaning apparatus may further comprise a rotatable brush and the another electrically powered member may comprise a brush motor drivingly connected to the rotatable brush.

In any embodiment, the second energy storage member may be provided in the surface cleaning head.

In any embodiment, the surface cleaning apparatus may comprise a portable cleaning unit which may comprise the air treatment member and the suction motor and the first energy storage member may be provided in the portable cleaning unit.

In any embodiment, the first charging output member may comprise first electrical contacts provided on a main body of the charging station.

In any embodiment, the second charging output member may comprise second electrical contacts provided on a main body of the charging station.

In any embodiment, the second charging output member may comprise a wireless charging member.

In any embodiment, the first energy storage member may have a first energy storage capacity and the second energy storage member may have a second energy storage capacity that differs to the first energy storage member.

In any embodiment, the charging station may comprise a first charging unit comprising the first charging output member and a second charging unit comprising the second charging output member wherein, in operation, the first charging unit may charge the first energy storage member at a first rate and the second charging unit may charge the second energy storage member at a second rate that differs to the first rate.

As discussed previously, the first energy storage member may be provided in a first location in the surface cleaning apparatus (e.g., a portable cleaning unit) and the second energy storage member may be provided in a second location (e.g., surface cleaning head). An advantage of this design is that components of the surface cleaning apparatus, such as a surface cleaning head and portable cleaning unit, may be separated while each component still retains an energy storage member. For example, the portable cleaning unit may be removed from the surface cleaning head and may be used as a hand vacuum cleaner with a suction motor powered by the first energy storage member. Alternately, the portable cleaning unit may be removed from the upright section of the surface cleaning apparatus while still in air flow communication with the surface cleaning head (e.g., via a flexible hose). However, as each of the portable cleaning unit and the surface cleaning head has its own energy storage member(s) that are on board, the portable cleaning unit and the surface cleaning head need not be electrically connected to each other, such as by using a e-hose. An e-hose tends to have less flexibility than a non-electrified hose and provides improved ease of use.

In accordance with this aspect, there is provided an apparatus comprising a surface cleaning apparatus and a charging station for the surface cleaning apparatus wherein:

a) the surface cleaning apparatus comprises:

i) a surface cleaning head having a dirty air inlet, ii) an air flow path extending from the dirty air inlet to a clean air outlet with an air treatment member and a suction motor provided in the air flow path;

iii) a first energy storage member provided at a first location in the surface cleaning apparatus; and, iv) a second energy storage member provided at a second location in the surface cleaning apparatus which is different from the first location, and b) the charging station comprises:

i) a first charging output member wherein, when the surface cleaning apparatus is docked at the charging station, the first charging output member is electrically chargeably connected with the first rechargeable energy storage member; and, ii) a second charging output member wherein, when the surface cleaning apparatus is docked at the charging station, the second charging output member is electrically chargeably connected with the second rechargeable energy storage member.

In any embodiment, the surface cleaning apparatus may comprise a portable cleaning unit which may comprises the air treatment member and the suction motor, and the first location may be in the portable cleaning unit.

In any embodiment, the surface cleaning apparatus may comprise a remainder portion to which the portable cleaning unit is removably mountable, the remainder portion may comprise the surface cleaning head, and the second location may be in the remainder portion.

In any embodiment, the second location may be in the surface cleaning head.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1B:
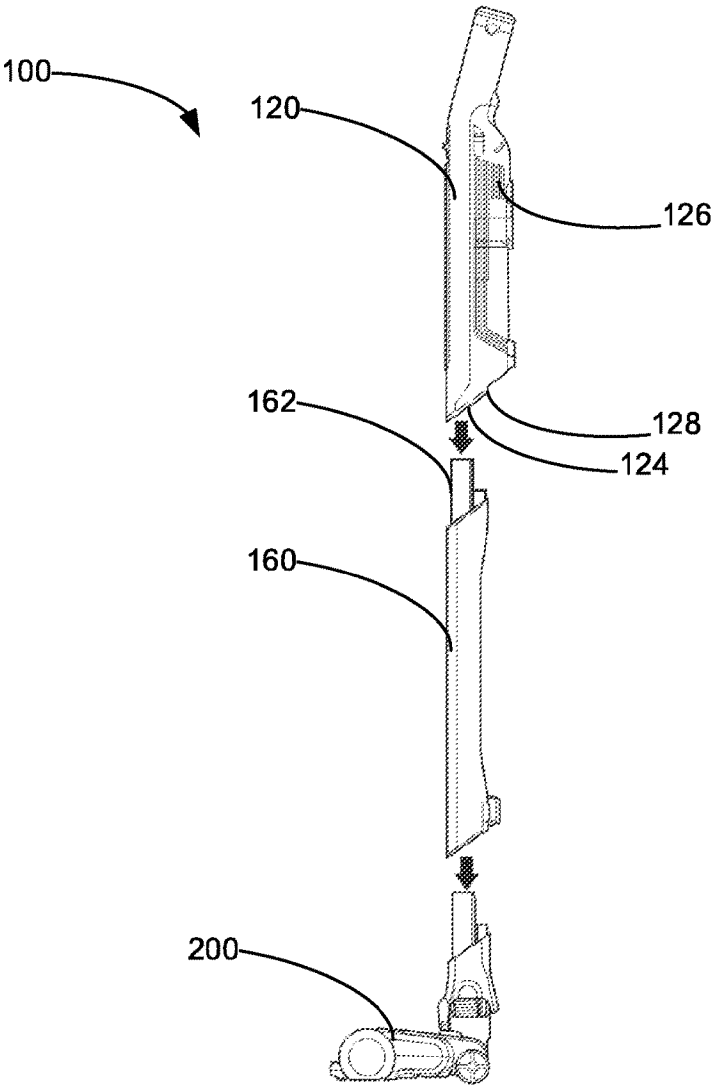
FIG. 1B is an exploded side view of the surface cleaning apparatus of FIG. 1A.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

As used herein, the wording "and/or" is intended to represent an inclusive—or. That is, "X and/or Y" is intended to mean X or Y or both, for example. As a further example, "X, Y, and/or Z" is intended to mean X or Y or Z or any combination thereof.

As used herein and in the claims, two elements are said to be "parallel" where those elements are parallel and spaced apart, or where those elements are collinear.

General Description of a Vacuum Cleaner

Figure 1A:
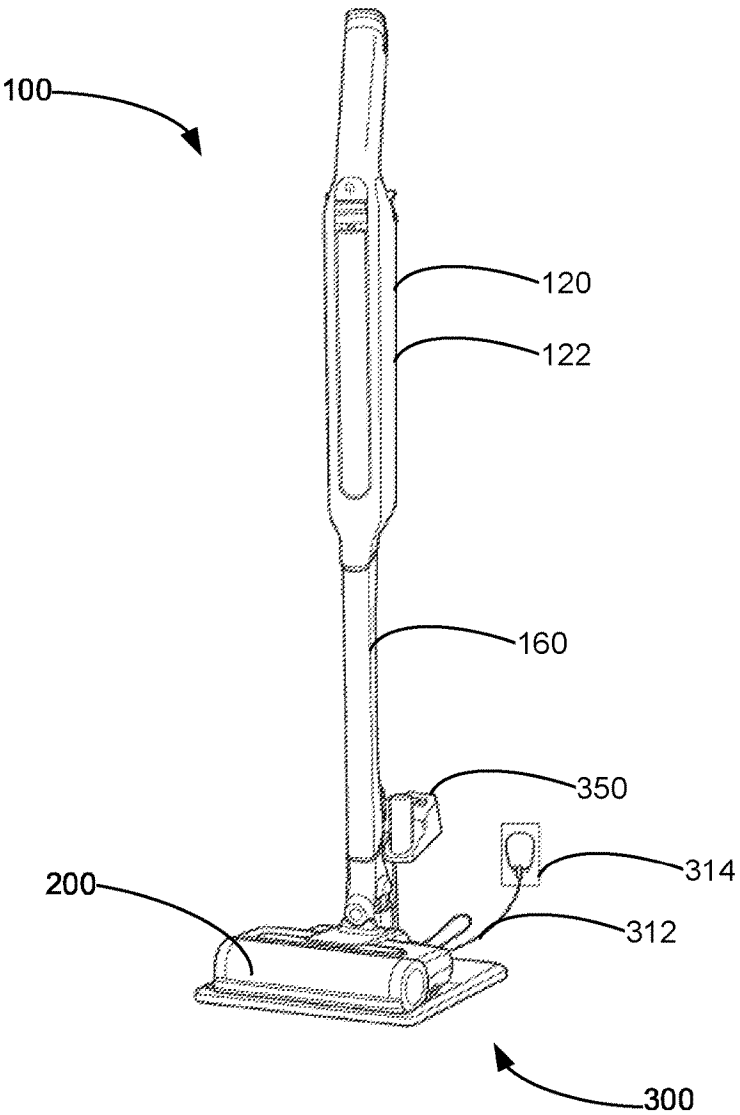
FIG. 1A is a front perspective view of a surface cleaning apparatus and a charging station in accordance with an embodiment.

Referring to FIGS. 1A-1B, an exemplary embodiment of a surface cleaning apparatus is shown generally as 100. The following is a general discussion of apparatus 100, which provides a basis for understanding several of the features that are discussed herein. As discussed subsequently, each of the features may be used individually or in any particular combination or sub-combination in this or in other embodiments disclosed herein.

Surface cleaning apparatus 100 may be any type of surface cleaning apparatus, including for example a stick vacuum cleaner as shown, a hand vacuum cleaner, an upright vacuum cleaner, a canister vacuum cleaner, an extractor, a robotic vacuum cleaner, a wet/dry type vacuum cleaner or any surface cleaning apparats wherein two different energy storage packs may be provided at different locations and/or wherein two energy storage packs may be charged concurrently.

In FIGS. 1-2, 5, 6A, and 8-9 surface cleaning apparatus 100 is illustrated as a stick vacuum cleaner. As exemplified, the stick vacuum cleaner includes a portable cleaning unit, which may also be referred to as a "hand vacuum cleaner", a "handvac" or "hand-held vacuum cleaner". As used herein, a hand vacuum cleaner is a vacuum cleaner that can be operated to clean a surface generally one-handedly. That is, the entire weight of the vacuum may be held by the same one hand used to direct a dirty air inlet of the vacuum cleaner with respect to a surface to be cleaned. This is to be contrasted with canister and upright vacuum cleaners, whose weight is typically supported by a surface (e.g., a floor) during use. When a canister vacuum cleaner is operated, or when an upright vacuum cleaner is operated in a 'lift-away' configuration, a second hand is typically required to direct the dirty air inlet at the end of a flexible hose.

Referring to FIGS. 1-2, 5, 6A, and 8-9, surface cleaning apparatus 100 includes a portable cleaning unit 120 having a main body or a handvac body 122 having an air treatment member (which may be permanently affixed to the main body or may be removable in part or in whole therefrom for emptying), a dirty air inlet 124 (which may be referred to as a nozzle of a handvac when the handvac is used by itself), a clean air outlet 126, and an air flow path extending between the dirty air inlet 124 and the clean air outlet 126. It will be appreciated that dirty air inlet 124 and clean air outlet 126 may be positioned in different locations of apparatus 100.

A suction motor 130 is provided to generate vacuum suction through air flow path. Suction motor 130 may be a fan-motor assembly including an electric motor and impeller blade(s). Suction motor 130 may be provide din main body 122. An air treatment member (not shown) is configured to remove particles of dirt and other debris from the air flow.

The air treatment member may be any air treatment member known in the surface cleaning arts. For example, the air treatment member may include a cyclone assembly (also referred to as a "cyclone bin assembly") having a single cyclonic cleaning stage with a single cyclone and a dirt collection chamber (also referred to as a "dirt collection region", "dirt collection bin", "dirt bin", or "dirt chamber"). The cyclone and dirt collection chamber may be of any configuration suitable for separating dirt from an air stream and collecting the separated dirt respectively, and may be in communication dirt outlet(s) of the cyclone chamber.

In alternate embodiments, the air treatment member may include a cyclone assembly having two or more cyclonic cleaning stages arranged in series with each other. Each cyclonic cleaning stage may include one or more cyclones arranged in parallel with each other and one or more dirt collection chambers, of any suitable configuration. The dirt collection chamber(s) may be external to the cyclone chambers of the cyclones. Each cyclone may have its own dirt collection chamber or two or more cyclones fluidically connected in parallel may have a single common dirt collection chamber.

In further alternate embodiments, the air treatment member may compromise a momentum separator or it may merely use filter media.

The hand vacuum cleaner 120 may include a pre-motor filter provided in the air flow path downstream of the air treatment member and upstream of suction motor 130. The pre-motor filter may be formed from any suitable physical, porous filter media. For example, the pre-motor filter may be one or more of a foam filter, felt filter, HEPA filter, or other physical filter media. In some embodiments, the pre-motor filter may include an electrostatic filter, or the like. The pre-motor filter may be located in a pre-motor filter housing that is external to the air treatment member.

As exemplified in FIG. 1B, dirty air inlet 124 is the inlet end of an air inlet conduit 128. Optionally, when the portable cleaning unit 120 has been removed from the upright section of the surface cleaning apparatus that is exemplified in FIG. 1B, the inlet end of air inlet conduit 128 can be used as a nozzle to directly clean a surface. Alternatively, or in addition to functioning as a nozzle, air inlet conduit 128 may be connected (e.g., directly connected) to the downstream end of any suitable accessory tool 318 such as a rigid air flow conduit (e.g., an above floor cleaning wand), a crevice tool, a mini brush, and the like. For example, as exemplified in FIG. 1B, wand 160 may be removable from cleaning head 200 and the air inlet conduit 128 of the hand vacuum cleaner 120 may be connected to the wand 160. The wand 160 may be used to extend the reach of the hand vacuum cleaner 120. As exemplified, the wand 160 may alternately or in addition provide an air flow conduit 162 for connecting the hand vacuum cleaner 120 to a surface cleaning head 200, having a dirty air inlet 202. In some embodiments, the hand vacuum cleaner 120 may be directly connectable to the surface cleaning head 200. In some embodiments, the wand 160 may be a separate accessory for lengthening the air inlet conduit 128 of the hand vacuum cleaner 120 and may not be in air flow communication with the surface cleaning head 200.

It will be appreciated that the surface cleaning head 200 may be any type of surface cleaning head. For example, the surface cleaning head 200 may be a dry cleaning head as exemplified, or may be a wet cleaning head such as a wet mop cleaning head or a carpet extractor.

It will be appreciated that the surface cleaning apparatus may be a reconfigurable upright surface cleaning apparatus which has a lift away portable cleaning unit that is removable from the upright section (e.g., removably mounted to a pivot member provided on the surface cleaning head which enables the portable cleaning unit to be reclined for floor cleaning when the portable cleaning unit is attached to the pivot member) such as is disclosed in U.S. Pat. Nos. 9,668,631; 9,801,511 and 10,299,649.

Accordingly, in operation, after activating the suction motor 130, dirty air enters apparatus 100 through dirty air inlet 124 and is directed along air inlet conduit 128 to the air treatment member. Dirt particles and other debris may be disentrained (i.e., separated) from the dirty air flow as the dirty air flow travels through the air treatment member. The disentrained dirt particles and debris may be discharged from the air treatment member into a dirt collection chamber, where the dirt particles and debris may be collected and stored until the dirt collection chamber is emptied.

Air exiting the air treatment member may be directed through the pre-motor filter, and then travel towards the suction motor 130 and then be discharged from apparatus 100 through clean air outlet 126. Prior to exiting the clean air outlet 126, the treated air may pass through an optional post-motor filter, which may be one or more layers of filter media.

Power may be supplied to the suction motor 130 and other electrical components of apparatus 100 from an onboard energy storage member, which may include, for example, one or more batteries, capacitors or other energy storage device.

Energy Storage Members

In accordance with this aspect, which may be used by itself or in combination with one or more other aspects, the surface cleaning apparatus 100 includes at least two energy storage members.

Optionally, the energy storage members may be used to supply power to different electrically powered members in the apparatus 100. For example, a first energy storage pack may be used to power a first electrically powered member (e.g., a suction motor) and a second energy storage pack may be used to power a second electrically powered member (e.g., a motor for a rotatable brush). These energy storage packs may have different capacities and may charge at different rates.

In accordance with such an optional embodiment, the energy storage packs may be provided in different locations in the apparatus 100. For example, in embodiments wherein a hand vacuum cleaner is separable from a surface cleaning head, a first energy storage pack may remain with the hand vacuum cleaner even when separated from the surface cleaning head and a second energy storage pack may remain with, e.g., the surface cleaning head when the hand vacuum cleaner is removed. It will be appreciated that, in such an embodiment, the first and second energy storage packs may have the same energy storage capacity or different energy storage capacities. It will be appreciated that if the energy storage packs have different capacities, then they may charge at different rates. Accordingly, the apparatus 100 may be charged more efficiently.

In accordance with another option, a surface cleaning apparatus may optionally removably receive a supplemental energy storage pack. For example, a surface cleaning apparatus may be sold with a first energy storage pack, which may power, e.g., the suction motor. The surface cleaning apparatus may be upgradable by a user installing a supplemental energy storage pack. The supplemental energy storage pack may also be used to power the suction motor and/or power an alternate electrically powered member (e.g., a motor for a rotatable brush). The supplemental energy storage member may have a different capacity to the capacity of the first energy storage pack.

In any of these embodiments, the charging station may be used to charge both energy storage packs simultaneously.

Figure 5:
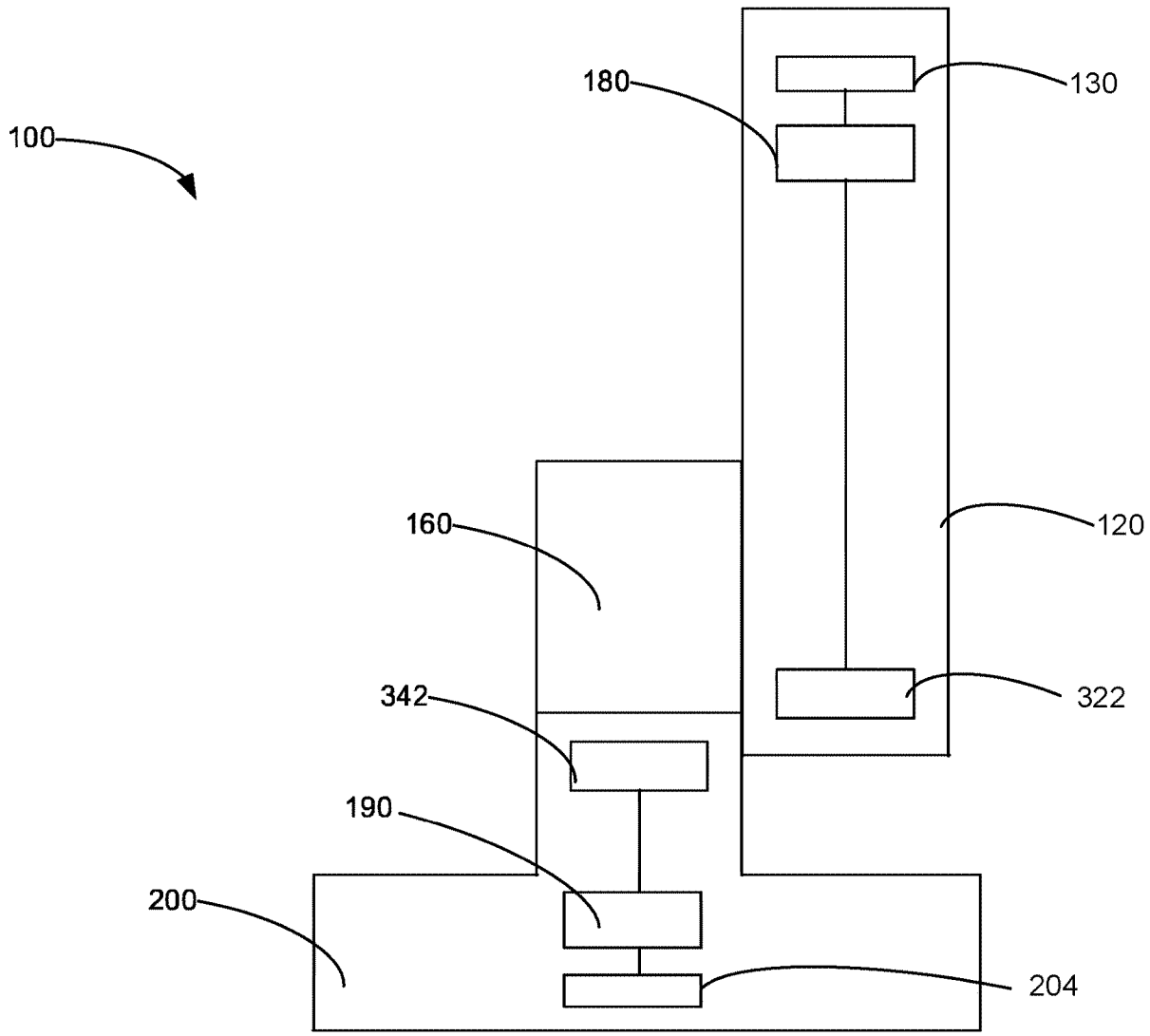
FIG. 5 is a schematic view of the surface cleaning apparatus of FIG. 2.
Figure 8:
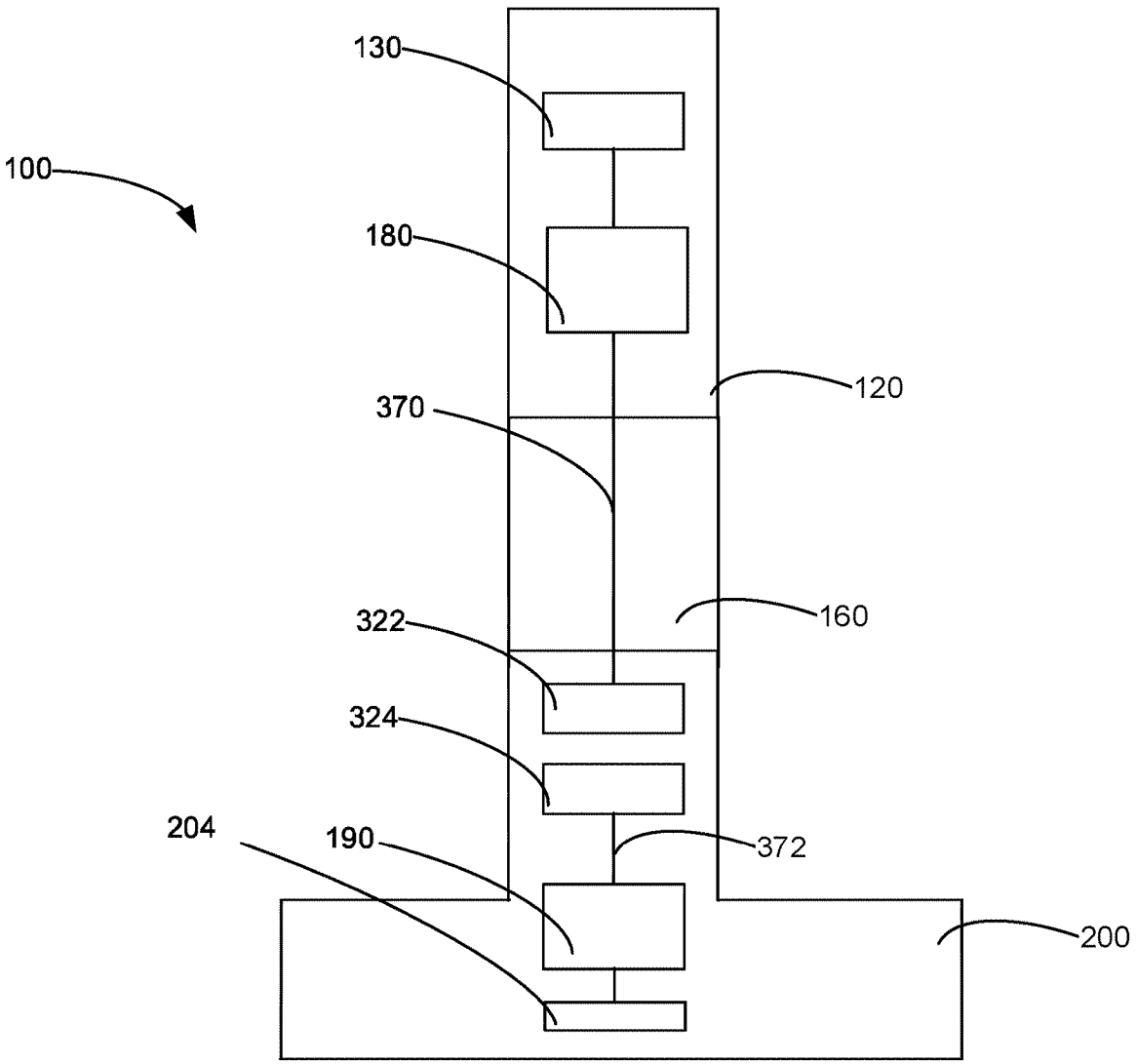
FIG. 8 is a schematic view of the surface cleaning apparatus of FIG. 6A.
Figure 9:
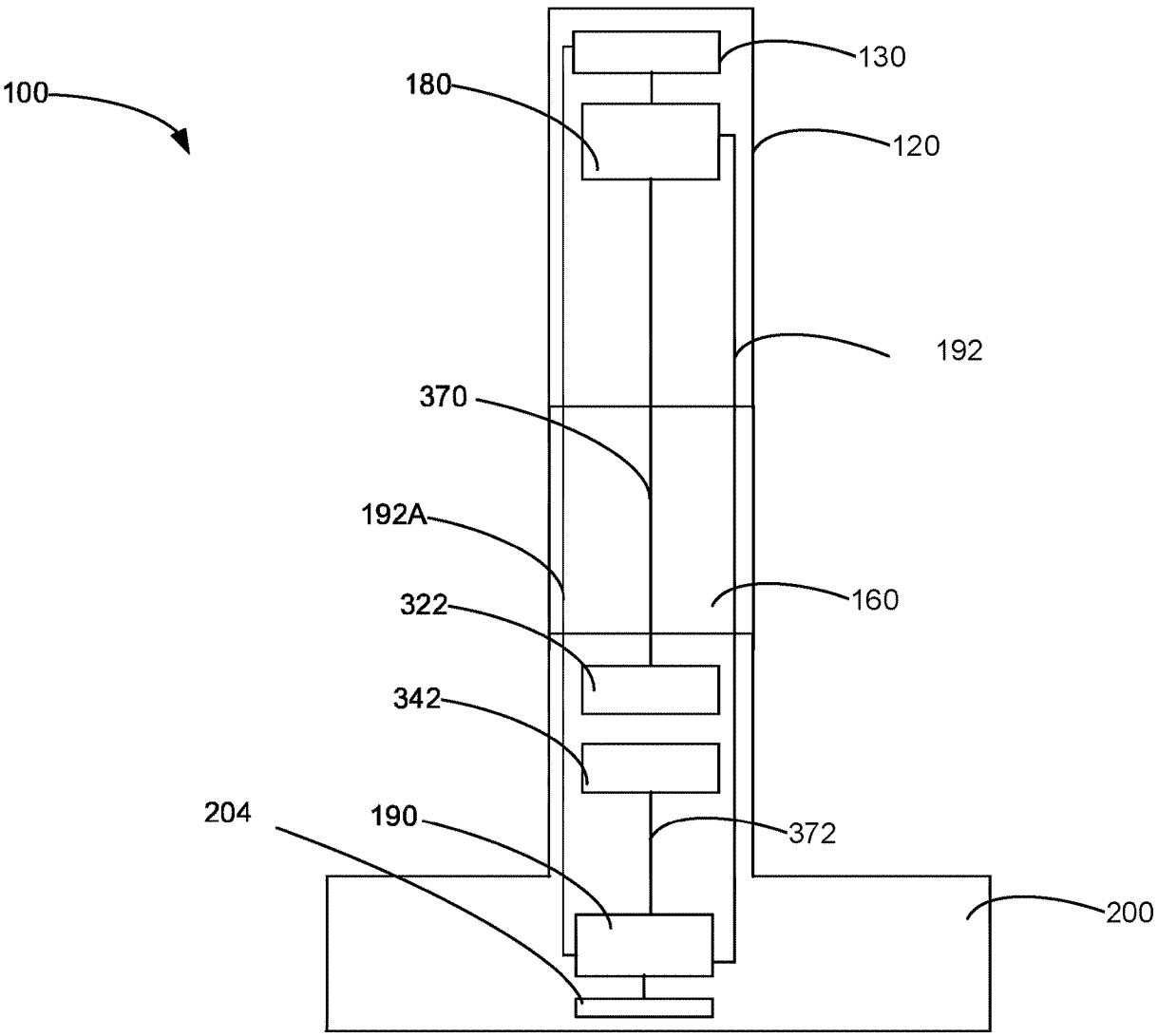
FIG. 9 is an alternate schematic view of the surface cleaning apparatus of FIG. 6A with a connection provided between a first energy storage member and a second energy storage member.
Figure 10B:
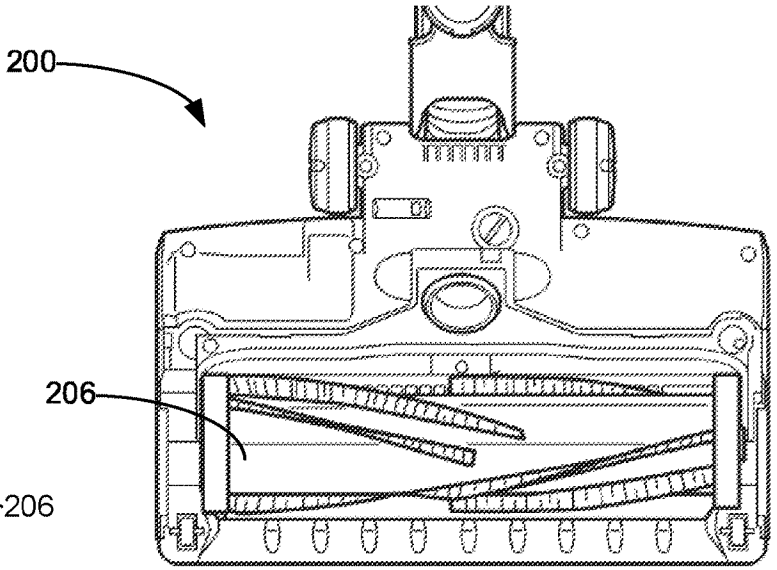
FIG. 10B is a bottom view of the surface cleaning head of FIG. 10A with a bottom panel removed; and, FIG. 10C is a rear view of the surface cleaning head of FIG. 10A.
Figure 10A:
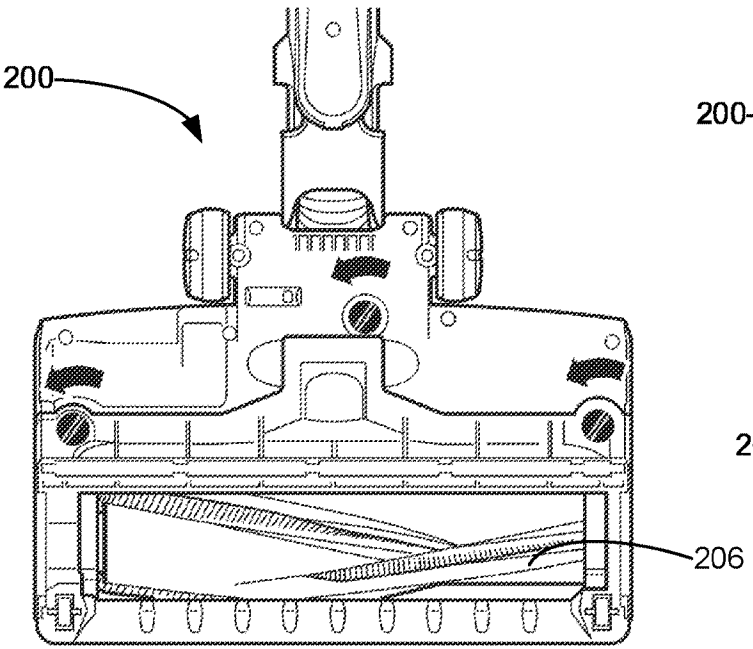
FIG. 10A is a bottom view of a surface cleaning head.
Figure 10C:
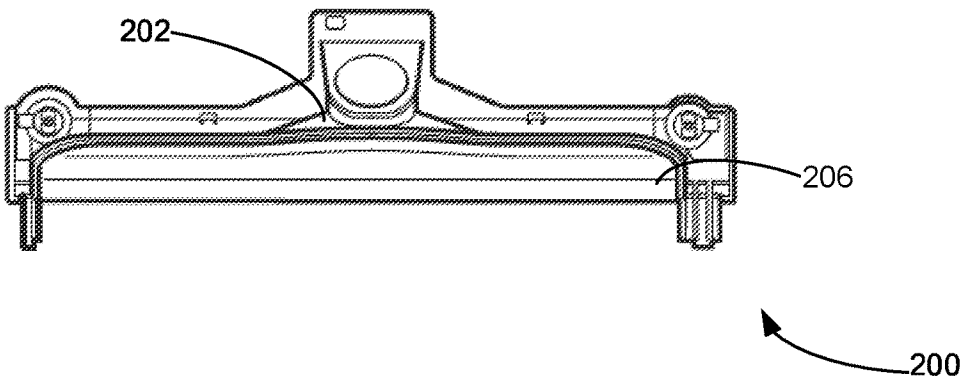

In accordance with this aspect, as exemplified in FIGS. 5, 8, and 9, the apparatus 100 has a first energy storage member 180 and a second energy storage member 190. It will be appreciated that the energy storage members may be any device capable of storing energy. For example, an energy storage member may be a battery, capacitor, ultra capacitor, or the like. It will be appreciated that each energy storage member may include a plurality of, for example, batteries or capacitors that are provided as a pack. The energy storage pack may be permanently connected to apparatus 100 or separately removable from apparatus 100. The energy storage members may be rechargeable in-situ, or rechargeable once removed from the apparatus 100. For convenience herein, reference is made to the first energy storage pack 180 and the second energy storage pack 190 and each such term may mean one or more energy storage members that may be provided in a pack.

Alternatively, or in addition to the energy storage members, power may be supplied to apparatus 100 by an electrical cord (not shown) connected to apparatus 100 that can be electrically connected to mains power at a standard wall electrical outlet. In some embodiments, the energy storage members may be charged through such an electrical cord.

It will be appreciated that the first energy storage pack 180 and the second energy storage pack 190 may be positioned in different locations in the surface cleaning apparatus 100, e.g., proximate the component that they power. For example, referring to FIGS. 1-2, 5, 6, and 8-9, the first energy storage pack 180 is provided in the portable cleaning unit 120 and the second energy storage pack 190 is provided in the surface cleaning head 200. In some embodiments, the portable cleaning unit 120 may be removably mountable to a remainder portion 210. As exemplified in FIG. 2, the remainder portion 210 includes the surface cleaning head 200 and the wand 160. The second energy storage pack 190 may be provided in the remainder portion 210. In other words, the second energy storage pack 190 may be provided in the surface cleaning head 200 and/or the wand 160. In some embodiments, each of the wand 160 and the surface cleaning head may have one or more energy storage packs.

The energy storage members of the surface cleaning apparatus 100 may be used to power one or more electrically powered members. Electrically powered members may include, but are not limited to, the suction motor, a brush motor, a resistively heated heat sink, an aluminum block, a display, an ozonator or any other component that may be used in a surface cleaning apparatus.

As exemplified in FIG. 5, the first energy storage pack 180 is electrically connected to the suction motor 130 and the second energy storage pack 190 is electrically connected to a brush motor 204 in the surface cleaning head 200. The brush motor 204 is drivingly connected to a rotatable brush 206. In operation, the brush motor 204 drives the rotatable brush 206 to assist with the entrainment of dirt and/or other debris from the surface to be cleaned through the dirty air inlet 202 in the surface cleaning head 200. Accordingly, as exemplified, each electrically powered member is powered by a different energy storage pack. In such an embodiment, each of the portable cleaning unit 200 and the surface cleaning head may be separately docked at the charging station as exemplified in FIG. 2.

Alternately, as exemplified in FIG. 8, the wand 160 may have comprise part of the electrical circuit between the first energy storage pack 180 and the docking station. Accordingly, the wand 160 may be connected to the portable cleaning unit 120 when the wand 160 and the portable cleaning unit 120 are docked at the charging station. In such an embodiment, the wand 160 may be connected to the surface cleaning head and the apparatus 100 may be docked as a unit at the charging station as exemplified in FIG. 6A.

The energy storage pack in the surface cleaning apparatus 100 may have the same or different energy storage capacities than another energy storage pack. For example, the first energy storage pack 180 may have twice the capacity of the second energy storage pack 190. The additional storage in the first energy storage pack 180 may be used to power the portable cleaning unit 120 for a longer period of time, to operate a component (e.g., a suction motor) that has a higher power draw and/or may be used to provide power to additional electrically powered members (e.g., a digital user interface).

In some embodiments, as exemplified in FIG. 9, one or both of the first and second energy storage packs may be electrically connected to a plurality of electrically powered members. For example, the second energy storage pack 190 positioned within the surface cleaning head 200 may be electrically connected to both the brush motor 204 and the suction motor 130, either directly by energy storage connector 192A or by the second energy storage pack 190 being electrically connected to the first energy storage pack 180 by energy storage connector 192. When the portable cleaning unit 120 is attached to the remainder portion 210, the second energy storage pack 190 may be used to supplement the power provided to the suction motor 130, thereby enabling increased suction force and/or run time. Accordingly, when the surface cleaning head 200 is in operation with the portable cleaning unit 120 attached to the remainder portion 210, the second energy storage pack 190 may facilitate improved cleaning by increasing the power provided to the suction motor 130, thereby increasing the suction force in the surface cleaning head 200 through the dirty air inlet 202.

In an embodiment such as that of FIG. 9, the second energy storage pack 190 positioned in the surface cleaning head 200 may have, for example, two, three, four or five times the capacity of the first energy storage pack 180 and may be electrically connected to the suction motor 130 in the portable cleaning unit 120 when the portable cleaning unit 120 is attached to the remainder portion 210. An advantage of this design is that if the second energy storage pack 190 is positioned, e.g., in or on the surface cleaning head 200, then the second energy storage pack 190 is provided at a lower elevation than the first energy storage pack 180, which lowers the centre of gravity of apparatus 100. Accordingly, the user may operate the surface cleaning apparatus 100 for a much longer period of time due to the larger capacity of the second energy storage pack 190, without additional discomfort from the added weight in the portable cleaning unit 120, which would be required if the additional energy storage pack were provided in the portable cleaning unit 120.

Alternatively, or in addition, the energy storage packs may be operable to transfer charge between each other. As exemplified in FIG. 9, the first energy storage pack 180 and the second energy storage pack 190 may be electrically connectable by an energy storage connector 192. Accordingly, energy may be transferred between energy storage packs 180, 190 to improve the operation of the surface cleaning apparatus 100. For example, if the first energy storage pack 180 is depleted and the second energy storage pack 190 is fully charged, the energy members may be balanced by transferring some of the charge from the second energy storage pack 190 to the first energy storage pack 180, thereby allowing the user to continue operating the surface cleaning apparatus 100 for a longer period of time.

In some embodiments, one or more energy storage packs may operate as a backup energy source. For example, if the first energy storage pack 180 positioned in the portable cleaning unit 120 is depleted, the second energy storage pack 190 may provide power to the suction motor 130 such that the user can continue operating the surface cleaning apparatus 100.

In some embodiments, a portion of the surface cleaning apparatus 100 may have a plurality of energy storage packs. For example, the energy storage pack 180 and the energy storage pack 190 may both be provided in the portable cleaning unit 120. When the portable cleaning unit 120 is detached from the remainder portion 210, both energy storage pack 190 and energy storage pack 190 may be used to provide power to the suction motor 130. When the portable cleaning unit 120 is attached to the remainder portion 210, the first energy storage pack 180 may be used to power the suction motor 130 while the second energy storage pack 190 may be used to power, for example, the brush motor 204 in the surface cleaning head 200. For example, the wand 160 and/or surface cleaning head 200 may have a mechanical or electrical member that, when attached to the portable cleaning unit 120, diverts power from the second energy storage pack 190 such that the electrically powered member positioned in the remainder portion 210 is powered.

In some embodiments, the surface cleaning apparatus 100 may include one or more electrical cords for directly connecting the energy storage packs 180 and 190 to a power source, independently from the charging station 300. For example, an electrical cord may be stored in an on-board storage chamber in the portable cleaning unit 120, the wand 160, and/or the surface cleaning head 200. The electrical cord may be retrieved from the onboard storage chamber and connected to a power source for charging the first energy storage pack 180 and/or the second energy storage pack 190. In some embodiments, the electrical cord may be removably attached to the apparatus 100. In some embodiments, the electrical cord may be used to charge both the first energy storage pack 180 and the second energy storage pack 190. For example, the electrical cord may be positioned within the portable cleaning unit 120 and the portable cleaning unit 120 may be electrically connected to the second energy storage pack 190 positioned in the surface cleaning head 200. When in use, the electrical cord provides power to the first energy storage pack 180 and to the second energy storage pack 190 through the wand 160 to the surface cleaning head 200.

Charging Station

In accordance with this aspect, which may be used by itself or in combination with one or more other aspects, there is provided a charging station 300 for a surface cleaning apparatus. The charging station 300 may be used to charge rechargeable energy storage members while they are positioned onboard the surface cleaning apparatus 100. As exemplified previously, the surface cleaning apparatus 100 may include a first energy storage pack 180 and a second energy storage pack 190. The charging station 300 may be used to charge each of the first energy storage pack 180 and the second energy storage pack 190, optionally concurrently. An advantage of this design is that the energy storage packs may be charged simultaneously, improving the charging efficiency of the surface cleaning apparatus 100.

In accordance with this aspect, each energy storage pack 180, 190 may be electrically connected to the charging dock in a single operation. Accordingly, when, for example, the surface cleaning apparatus is placed in the charging station, the single act of docking the surface cleaning apparatus to the charging station 300 may electrically connect each of the energy storage packs, regardless of their location in the surface cleaning apparatus 100, to the charging station 300.

Figure 6B:
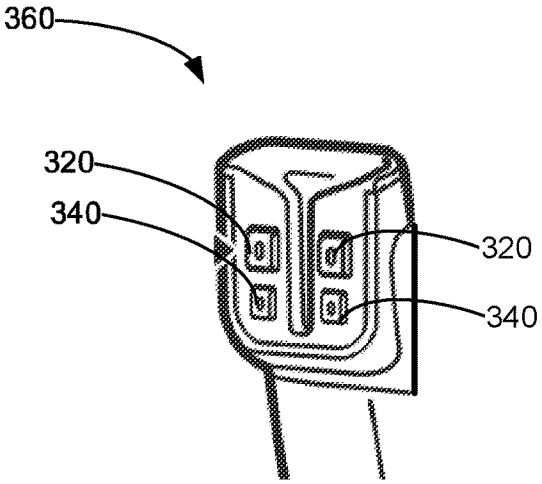
FIG. 6B is a front perspective view of a charging unit of the charging station of FIG. 6A.
Figure 6A:
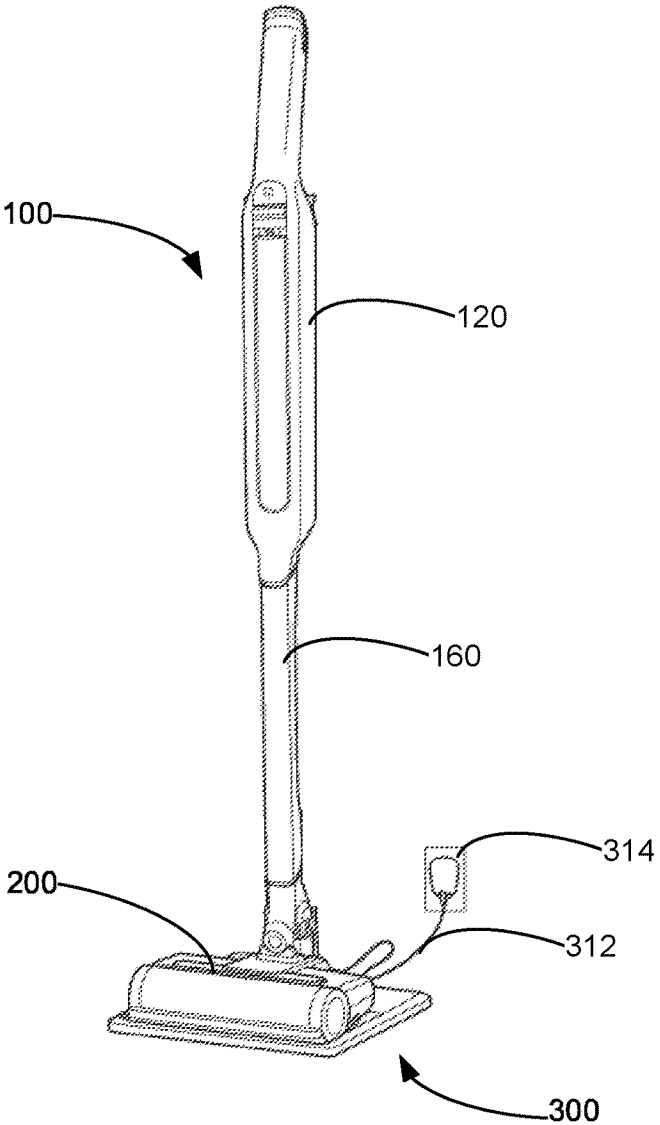
FIG. 6A is a front perspective view of another exemplary surface cleaning apparatus and charging station.
Figure 7B:
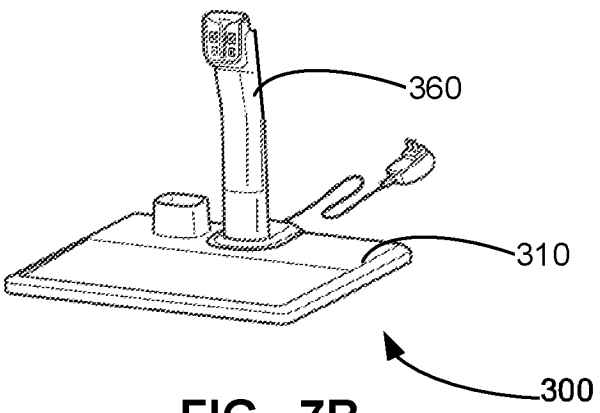
FIG. 7B is a front perspective view of the charging station of FIG. 6A with the charging unit attached to the charging station.
Figure 7A:
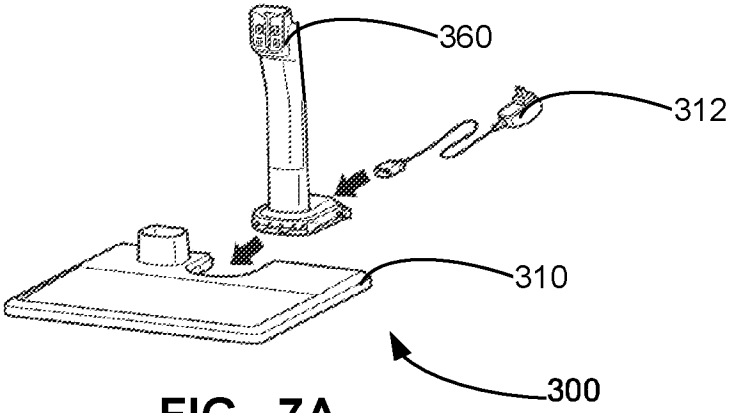
FIG. 7A is a front perspective view of the charging station of FIG. 6A with the charging unit detached from the charging station.
Figure 7C:
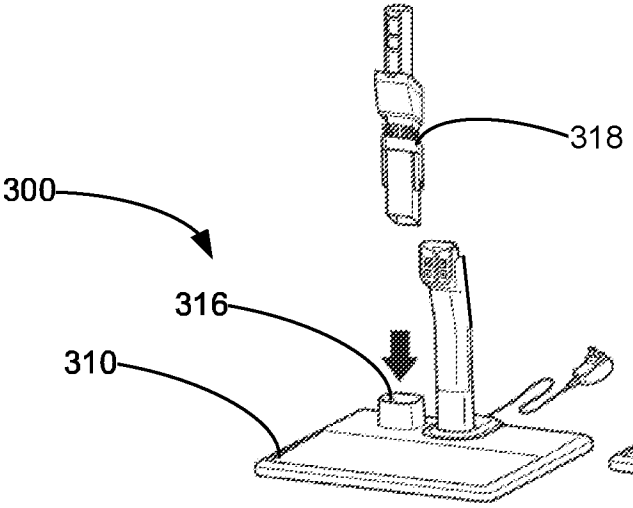
FIG. 7C is a front perspective view of the charging station of FIG. 6A with an accessory detached from the charging station.
Figure 7D:
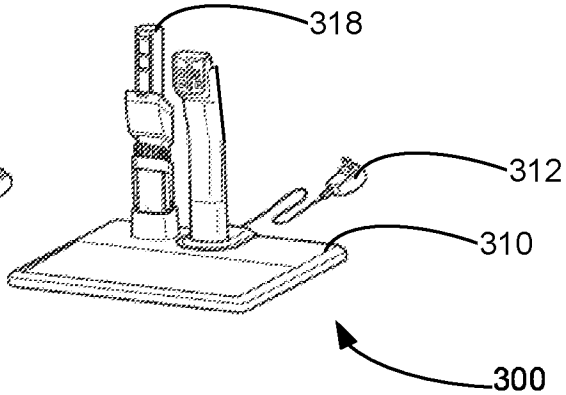
FIG. 7D is a front perspective view of the charging station of FIG. 6A with the accessory attached to the charging station.

For example, as exemplified in FIG. 6B, the charging station 300 has a first charging output member 320 and a second charging output member 340. Each charging output member 320, 340 is positioned so as to electrically connect with one of the energy storage packs 180, 190 when the surface cleaning apparatus 100 is docked at the charging station 300.

As exemplified in FIGS. 1A and 4A-4D, the charging station 300 has an electrical cord 312 electrically coupled to the main body 310 and electrically couplable to a power supply 314 (e.g., an electrical outlet of the household mains). The first charging output member 320 and the second charging output member 340 are positioned on a main body 310 of the charging station 300. When the surface cleaning apparatus 100 is docked at the charging station 300, as exemplified in FIGS. 1A, 2, and 6A, the first charging output member 320 is electrically chargeably connected with the first energy storage pack 180 and the second charging output member 340 is electrically chargeably connected with the second energy storage pack 190. Accordingly, during use, the charging station 300 charges the first and second energy storage packs 180, 190 through the first and second charging output members 320, 340, respectively.

It will be appreciated that the charging output members may be any device capable of transferring a charge from a main power supply to an energy storage pack. For example, the charging output members may provide power wirelessly, such as through RF or inductive charging, or through physical contact, such as electrical contacts. As exemplified in FIGS. 3B, 4A-4D, 6B, and 7A-7D, the first charging output member 320 is a first pair of electrical contacts and the second charging output member 340 is a second pair of electrical contacts.

The first charging output member 320 and second charging output member 340 may be positioned on one or more charging units. As exemplified in FIGS. 1-4D, the charging station 300 has a first charging unit 330 and a second charging unit 350. The first charging unit 330 includes the first charging output member 320 and the second charging unit 350 includes the second charging output member 340. Accordingly, the portable cleaning unit may be mounted to the second charging unit 350 and the remainder 210 may be mounted to the first charging unit 330. In this configuration, each of the portable cleaning unit 120 and the remainder 210 are mounted in position in the charging station and electrically connected to the charging units 330, 350.

The surface cleaning apparatus 100 includes reciprocal electrical contacts for electrically connecting with the first charging output member 320 and the second charging output member 340. As exemplified in FIG. 5, the portable cleaning unit 120 has a first reciprocal contact 322 and the surface cleaning head 200 has a second reciprocal contact 342. The first reciprocal contact 322 electrically chargeably connects the first energy storage pack 180 to the first electrical contacts 320 and the second reciprocal contact 342 electrically chargeably connects the second energy storage pack 190 to the second electrical contacts 340.

In some embodiments, as exemplified in FIGS. 6A-9, the charging station 300 may have a single charging unit 360. As shown, the first charging output member 320 and the second charging output member 340 are both positioned on the charging unit 360. As exemplified in FIGS. 8-9, when there is a single charging unit 360, the first reciprocal contact 322 and the second reciprocal contact 342 may both positioned on the remainder portion 210 of the surface cleaning apparatus 100. In particular, the first reciprocal contact 322 and the second reciprocal contact 342 are exemplified as both being positioned on the surface cleaning head 200. As exemplified, the surface cleaning head 200 and the wand 160 have an electrical connector 370 for electrically chargeably connecting the first energy storage pack 180 to the charging station 300. It will be appreciated that the electrical connector 370 may connect the first energy storage pack 180 to the first reciprocal contact 322 with or without the presence of the wand 160.

In some embodiments, the portable cleaning unit 120 may also have reciprocal contacts for electrically chargeably connecting to the single charging unit 360 when the remainder portion 210 is not positioned on the charging station 300. Accordingly, the portable cleaning unit 120 may be charged independently from the remainder portion 210 on the same charging unit 360.

Figure 2:
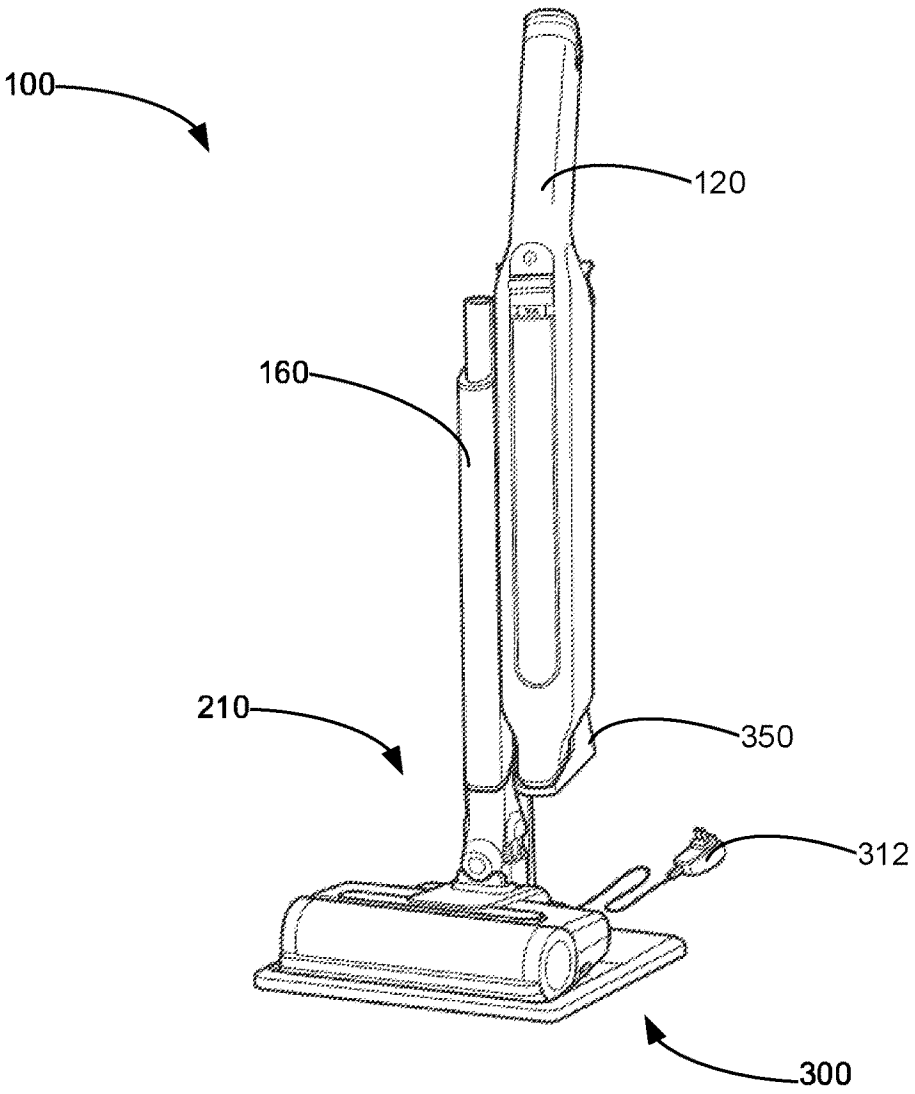
FIG. 2 is a front perspective view of the surface cleaning apparatus and charging station in another configuration.
Figure 3B:
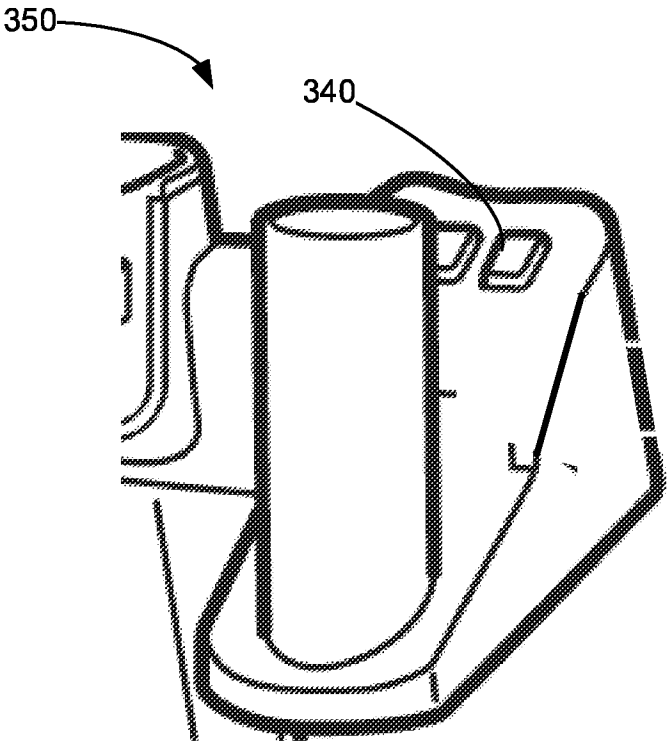
FIG. 3B is a front perspective view of a second charging unit of the charging station of FIG. 1A.
Figure 3A:
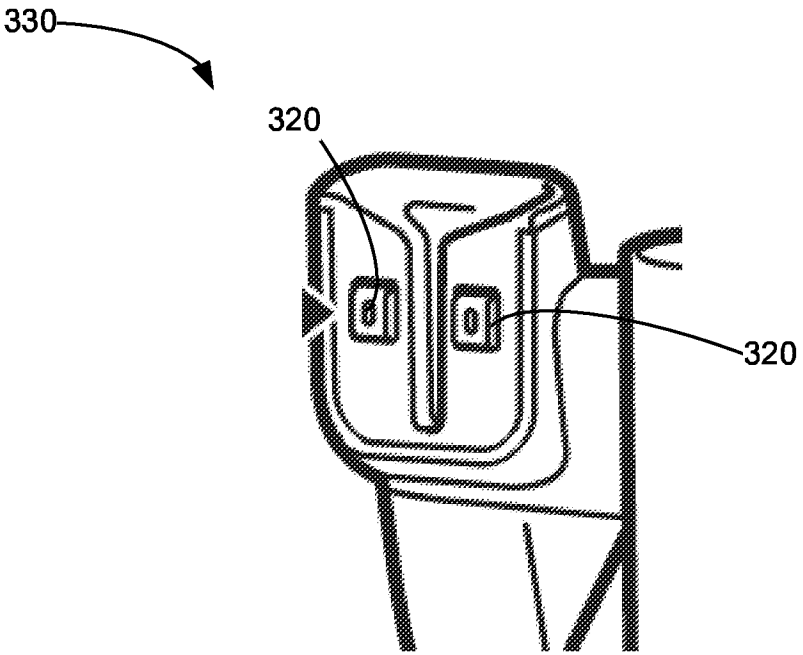
FIG. 3A is a front perspective view of a first charging unit of the charging station of FIG. 1A.
Figure 4B:
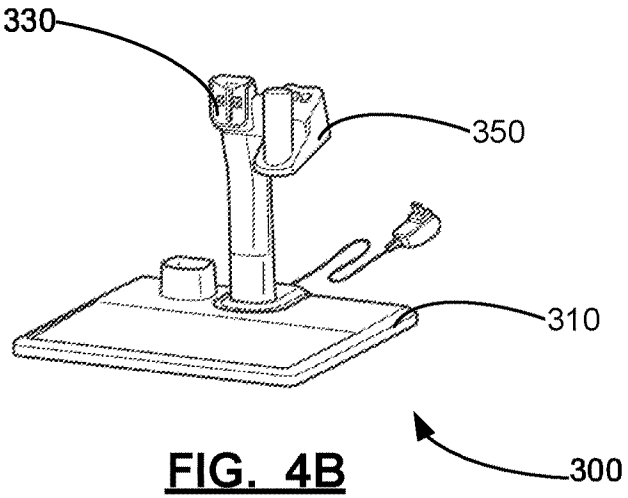
FIG. 4B is a front perspective view of the charging station of FIG. 1A with the charging units attached to the charging station.
Figure 4A:
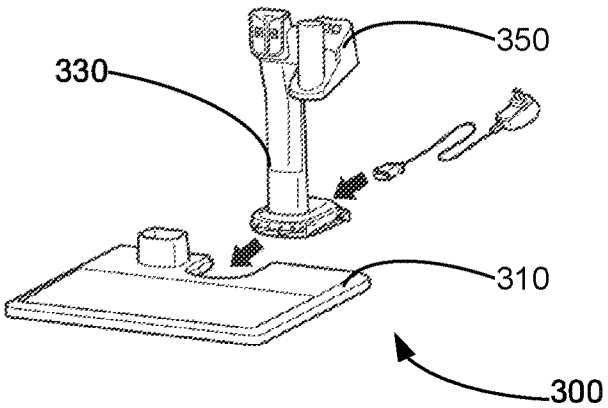
FIG. 4A is a front perspective view of the charging station of FIG. 1A with the charging units detached from the charging station.
Figure 4D:
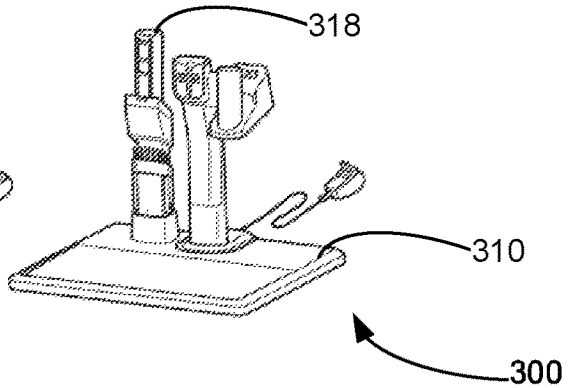
FIG. 4D is a front perspective view of the charging station of FIG. 1A with the accessory attached to the charging station.
Figure 4C:
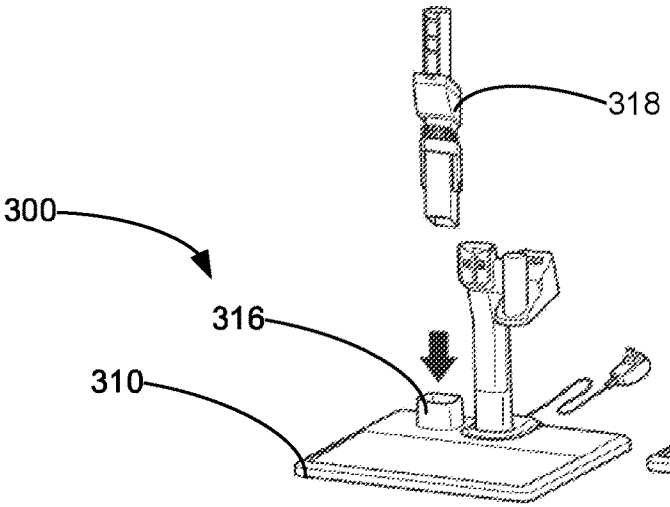
FIG. 4C is a front perspective view of the charging station of FIG. 1A with an accessory detached from the charging station.

It will be appreciated that, in the embodiment of FIG. 2, charging station 300 may have a charging station 360 as exemplified in FIG. 6B and the single changing station 350. In such an embodiment, the portable cleaning unit may be charged when the portable cleaning unit 120 is mounted to the remainder 210 (as exemplified in FIG. 6A) or when removed from the remainder 210 and separately mounted on the charging station 350 (as exemplified in FIG. 2).

In some embodiments, the charging units may be removably attachable to the main body 310 of the charging station 300. As exemplified in FIGS. 4A and 4B, the first charging unit 330 and the second charging unit 350 are removable from the main body 310. An advantage of this design is that the charging station 300 may be more easily stored. Another advantage is that the charging units may be replaced if damaged. Similarly, as exemplified in FIGS. 7A and 7B, the single charging unit 360 may be removable from the main body 310.

As described previously, the first energy storage pack 180 and the second energy storage pack 190 may be removable from the surface cleaning apparatus 100. In some embodiments, the charging station 300 may receive the removed first and second energy storage packs 180, 190 and may charge the energy storage packs directly.

As exemplified in FIGS. 4A-4D and 7A-7D, the charging station main body 310 may include an accessory storage member 316 for receiving one or more accessories 318. If the accessory has an energy storage pack, then the accessory storage member 316 may also include a charging unit.

It will be appreciated that, in an alternate embodiment, such as the embodiment of FIG. 2, the charging station 300 may have a single charging station with only a single charging output member (e.g., charging output member 320 or 340). The surface cleaning apparatus 100 may have a single reciprocal contact 322 or 342. However, the single reciprocal contact 322 or 342 may connect to two different circuits, as exemplified in 8, wherein electrical connector 370 extends from the single reciprocal connector to the first energy storage pack 180 and electrical connector 372 extends from the single reciprocal connector to the first energy storage pack 190.

It will be appreciated that, in some embodiments, the charging units 330, 350 may have different charging rates. For example, the first charging unit 330 may charge the first energy storage pack 180 at a first rate and the second charging unit 350 may charge the second energy storage pack 190 at a second rate different than the first rate. The charging rates may be determined such that both energy storage packs may be fully charged at the same time. Therefore, the energy storage pack which has the higher storage capacity (e.g., the first energy storage pack which powers the suction motor) may be charged faster than a second energy storage pack (e.g., the second energy storage pack that powers the brush motor), which may have a lower storage capacity. It will be appreciated that, both energy storage packs may be charged, e.g., at a rate of 1 C, 2 C or 3 C, etc.

It will also be appreciated that, in an alternate embodiment, both energy storage packs may be provided with power at the same rate. In such a case, the energy storage pack having a lower storage capacity (e.g., the second energy storage pack that powers the brush motor) may be charged before the energy storage pack having a higher storage capacity (e.g., the first energy storage pack which powers the suction motor) is charged. In such a case, once the energy storage pack having the lower storage capacity is charged, the charging of that energy storage pack may be terminated and additional power may then be diverted to charge the energy storage pack having the higher storage capacity.

It will also be appreciated that the charging station 300 may be of any design that supports the surface cleaning apparatus 100 and any part thereof (e.g., portable cleaning unit 120) in a fixed position while they are docked.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. An apparatus comprising a surface cleaning apparatus and a charging station for the surface cleaning apparatus wherein:

(a) the surface cleaning apparatus comprises:

i) a surface cleaning head having a dirty air inlet, ii) an air flow path extending from the dirty air inlet to a clean air outlet with an air treatment member and a suction motor provided in the air flow path;

iii) a first energy storage member which, in operation, is electrically connected to the suction motor; and, iv) a second energy storage member which, in operation, is electrically connected to another electrically powered member, and (b) the charging station comprises:

i) a first charging output member wherein, when the surface cleaning apparatus is docked at the charging station, the first charging output member is electrically chargeably connected with the first rechargeable energy storage member; and, ii) a second charging output member wherein, when the surface cleaning apparatus is docked at the charging station, the second charging output member is electrically chargeably connected with the second rechargeable energy storage member.

2. The apparatus of claim 1 wherein the first rechargeable energy storage member and the second rechargeable energy storage member are provided at different locations on the surface cleaning apparatus.

3. The apparatus of claim 1 wherein the surface cleaning apparatus further comprises a rotatable brush and the another electrically powered member comprises a brush motor drivingly connected to the rotatable brush.

4. The apparatus of claim 3 wherein the second energy storage member is provided in the surface cleaning head.

5. The apparatus of claim 4 wherein the surface cleaning apparatus comprises a portable cleaning unit which comprises the air treatment member and the suction motor and the first energy storage member is provided in the portable cleaning unit.

6. The apparatus of claim 1 wherein the first charging output member comprises first electrical contacts provided on a main body of the charging station.

7. The apparatus of claim 6 wherein the second charging output member comprises second electrical contacts provided on a main body of the charging station.

8. The apparatus of claim 1 wherein the second charging output member comprises a wireless charging member.

9. The apparatus of claim 1 wherein the first energy storage member has a first energy storage capacity and the second energy storage member has a second energy storage capacity that differs to the first energy storage member.

10. The apparatus of claim 9 wherein the charging station comprises a first charging unit comprising the first charging output member and a second charging unit comprising the second charging output member wherein, in operation, the first charging unit charges the first energy storage member at a first rate and the second charging unit charges the second energy storage member at a second rate that differs to the first rate.

11. An apparatus comprising a surface cleaning apparatus and a charging station for the surface cleaning apparatus wherein:

(a) the surface cleaning apparatus comprises:

i) a surface cleaning head having a dirty air inlet, ii) an air flow path extending from the dirty air inlet to a clean air outlet with an air treatment member and a suction motor provided in the air flow path;

iii) a first energy storage member provided at a first location in the surface cleaning apparatus; and, iv) a second energy storage member provided at a second location in the surface cleaning apparatus which is different from the first location, and (b) the charging station comprises:

i) a first charging output member wherein, when the surface cleaning apparatus is docked at the charging station, the first charging output member is electrically chargeably connected with the first rechargeable energy storage member; and, ii) a second charging output member wherein, when the surface cleaning apparatus is docked at the charging station, the second charging output member is electrically chargeably connected with the second rechargeable energy storage member.

12. The apparatus of claim 11 wherein the surface cleaning apparatus comprises a portable cleaning unit which comprises the air treatment member and the suction motor, and the first location is in the portable cleaning unit.

13. The apparatus of claim 12 wherein the surface cleaning apparatus comprises a remainder portion to which the portable cleaning unit is removably mountable, the remainder portion comprises the surface cleaning head, and the second location is in the remainder portion.

14. The apparatus of claim 13 wherein the second location is in the surface cleaning head.

* * * * *